United States Patent [19]

Charles et al.

[11] 4,350,323

[45] Sep. 21, 1982

[54] DEVICE FOR RECOVERY OF A CABLE FOR HANDLING A SUBMERGED LOAD

[75] Inventors: Joël M. Charles, Toulon; Robert J. Toscano, La Seyne/Mer, both of France

[73] Assignee: Etat Francais as represented by the Delegue General pour l'Armement, Armees, France

[21] Appl. No.: 177,606

[22] Filed: Aug. 13, 1980

[30] Foreign Application Priority Data

Aug. 27, 1979 [FR] France ..... 79 21424

[51] Int. Cl.[3] ..... B66D 1/50

[52] U.S. Cl. ..... 254/273; 254/271; 254/288; 254/331; 254/389; 242/158 R

[58] Field of Search ..... 254/273, 271, 270, 288, 254/331, 383, 389, 394, 395, 287, 134.3 SC; 242/158.2, 158.3, 158 R, 157 R, 157.1

[56] References Cited

U.S. PATENT DOCUMENTS

| | | | |
|---|---|---|---|
| 3,048,370 | 8/1962 | Kratzer | 242/158 R X |
| 3,052,425 | 8/1962 | Reed et al. | 242/157 R X |
| 3,112,895 | 12/1963 | Kinney | 242/158.2 X |
| 3,456,899 | 7/1969 | Smith et al. | 254/331 X |
| 3,481,583 | 12/1969 | Ulbing | 242/158.2 X |
| 3,514,048 | 5/1970 | Lowery | 242/157 R |
| 3,836,123 | 9/1974 | Bausenbach et al. | 242/157.1 |

*Primary Examiner*—John M. Jillions

*Attorney, Agent, or Firm*—Stevens, Davis, Miller & Mosher

[57] ABSTRACT

This invention generally relates to a cable recovery device for use on board a surface ship. The invention compensates for excessive tensions arising in cables carrying submerged loads which are caused by the swell of the ocean acting on the ship, and controls the tension at which the cable is wound. The invention includes a cable winding drum which is rotationally driven by a variable-speed motor, a loop-shaped cable passageway which circumscribes the drum which forms a loop of cable of varying length, and a means for sensing the length of said cable loop and for automatically controlling the speed of the variable speed motor in response thereto. The loop of cable of varying length compensates for excessive cable tensions resulting from the swell of the ship, and allows the cable to be wound around the drum at a desired uniform tension.

8 Claims, 6 Drawing Figures

FIG. 5
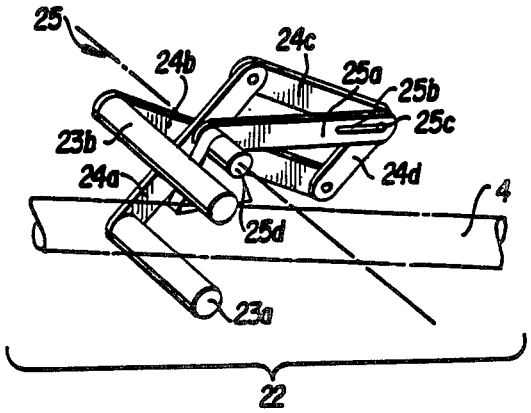
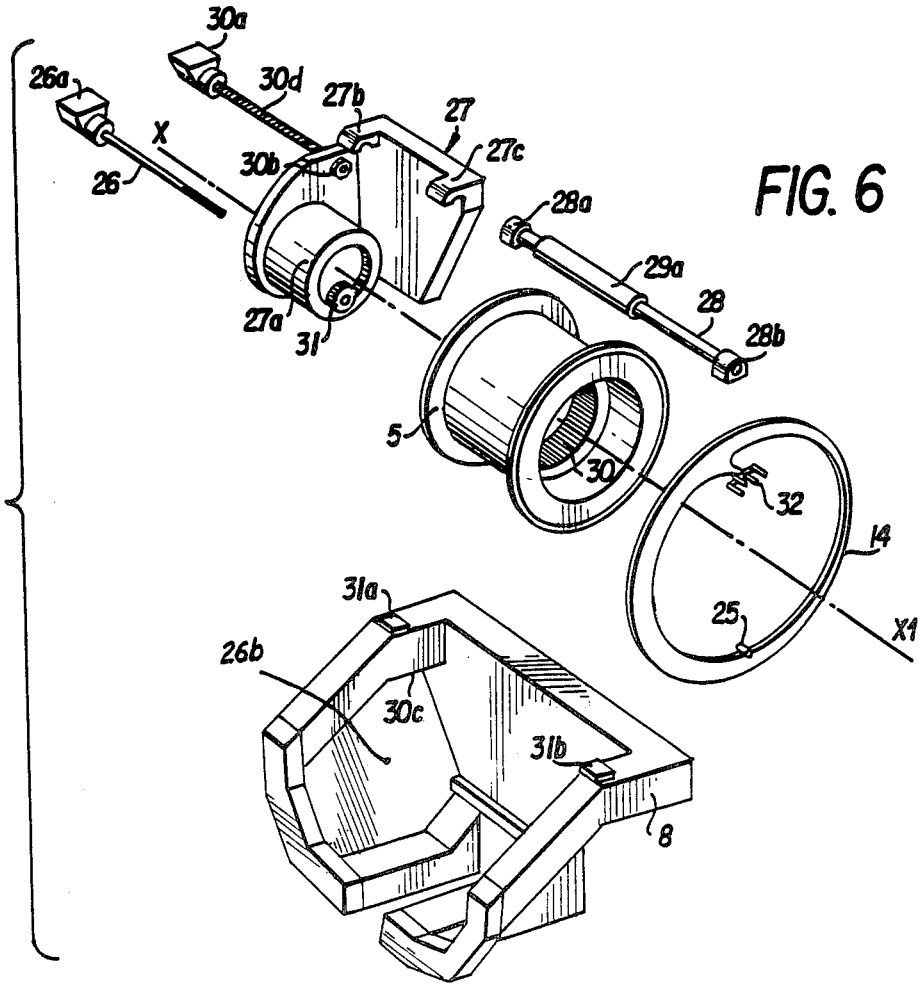
FIG. 6

DEVICE FOR RECOVERY OF A CABLE FOR HANDLING A SUBMERGED LOAD

The object of the present invention is a device for recovery of a cable for handling a submerged load.

The technical field of the invention is that of the construction of the appliances situated on board of boats intended for handling submerged loads which are hooked onto the end of a cable.

The handling at sea of a submerged load which is hooked onto the end of a towing or hauling cable which connects it to a surface vessel, poses problems because of the motions of the boat due to the swell.

These problems are the more difficult to solve when it is a question of loads submerged to a great depth as is the case with machines for reconnaissance of the ocean deeps situated at depths of several thousand meters which necessitate the handling of cables of great length and of large diameter which may be haulage cables or electrical conductor cables.

In view of the high tensions to which these cables are subjected it would be dangerous to wind these cables under tension round a winch drum or to make them pass over guide pulleys which impose upon them changes in direction, because of the radial forces from which there would be a risk of crushing the cable.

In this case devices are employed for recovery of the cable which include a spool or a drum for recovery of the cable which is driven in rotation by a motor of low power and over which the cable is wound whilst being subjected to a low tension, for example, a tension of only some thousands of newtons.

In a separate patent application Ser. No. 177,605 a device has been described for handling from a boat a submerged load hooked to the end of a cable, this device including an appliance for straightline haulage upon the cable, placed upon a straight beam articulated to the stern of a ship and likewise including a device for recovery of the cable located at the top end of the beam in order to form in combination with it a compact handling device mounted upon a turret articulated about a vertical axis.

The object of the present application is a cable recovery device which may be employed in such a combination, it being specified that this particular application is not restrictive and that a cable recovery device in accordance with the invention may be employed on board a boat in association with any appliance for straightline haulage upon the cable located between the submerged load and the drum for recovery of the cable.

The problem to be solved in the case of a device for recovery of a cable of great length, which is located on board a ship, is to avoid the motions of the ship due to the pounding or to the swell causing dangerous increases in tension of the cable.

This problem is solved by a cable recovery device in accordance with the invention which includes firstly a drum which is driven in rotation about an axis by a variable-speed motor and upon which the cable is wound whilst being not very much stretched, and secondly a passageway in the shape of a loop which surrounds the said drum and through which the said cable passes whilst making round the said drum a loop of variable length.

Preferably the loop-shaped passageway is composed of two cheeks which are perpendicular to the axis of the drum and the separation of which is very slightly greater than the diameter of the cable, and of two cylindrical surfaces the generatrices of which are parallel with the axis of drum and the said cheeks and the said surfaces form the four sides of the said passageway which surrounds the lower portion of the periphery of the said drum and through which passes the said loop of cable of variable length.

In accordance with a preferred embodiment the two cylindrical surfaces include an inner surface which entirely surrounds the periphery of the said drum and an outer surface in the shape of a cylindrical sector which surrounds solely the underneath of the said drum and the ends of which rejoin the first surface so that it defines with the latter and with the two cheeks a substantially closed volume of crescent shape which extends over the lower half of the periphery of the said drum. Further, the device in accordance with the invention include means of sucking out the air lying in the said crescent-shaped volume between the loop of cable and the outer surface in order to create a reduced pressure which draws the loop of cable towards the outer surface.

A device in accordance with the invention includes in addition inside the crescent-shaped volume an arm one end of which is articulated about an axis parallel with the axis of the drum, the arm carrying at its opposite end a means of guidance of the cable through which passes the said loop of cable of variable length and the device includes in addition a pick-up of the angular position of the said arm which automatically controls the speed of the said motor for driving the drum and which makes it vary in the sense which keeps the said arm in a substantially constant angular position.

The result of the invention is a new cable recovery device intended particularly for being installed on board a surface vessel in association with an appliance for straightline haulage upon the cable for handling a submerged load hooked to the end of the cable.

A device in accordance with the invention enables the influence of the motions of the boat upon the cable to be compensated thanks to the loop of variable length which is formed inside the passageway which partially surrounds the said drum and which acts as an inertia compensator. During the raising of the load, when the boat is subjected to an upwards speed which is added to the speed of the appliance for straightline haulage, the radius of the loop of cable increases, which enables the difference of the speed of the drum and of the linear haulage appliance to be compensated temporarily. Conversely when the boat drops the loop of cable shrinks. The pick-up of the position of the loop enables the driving speed of the cable recovery drum to be acted upon automatically in order to keep the total length of the loop within limits compatible with the dimensions of the passageway but the action upon the motor and the changing of the speed of the drum are not instantaneous and display a certain inertia whilst the variations in length of the loop of cable may occur very rapidly and hence enable the inertia of the recovery drum and of the mechanism which drives it in rotation to be compensated.

The following description refers to the attached drawings which represent without any restrictive character an embodiment of a cable recovery device in accordance with the invention.

FIG. 5 is a perspective of a pick-up of the angular position of the cable.

FIG. 6 is an exploded perspective of the devices for driving the cable recovery drum.

Figure 1:
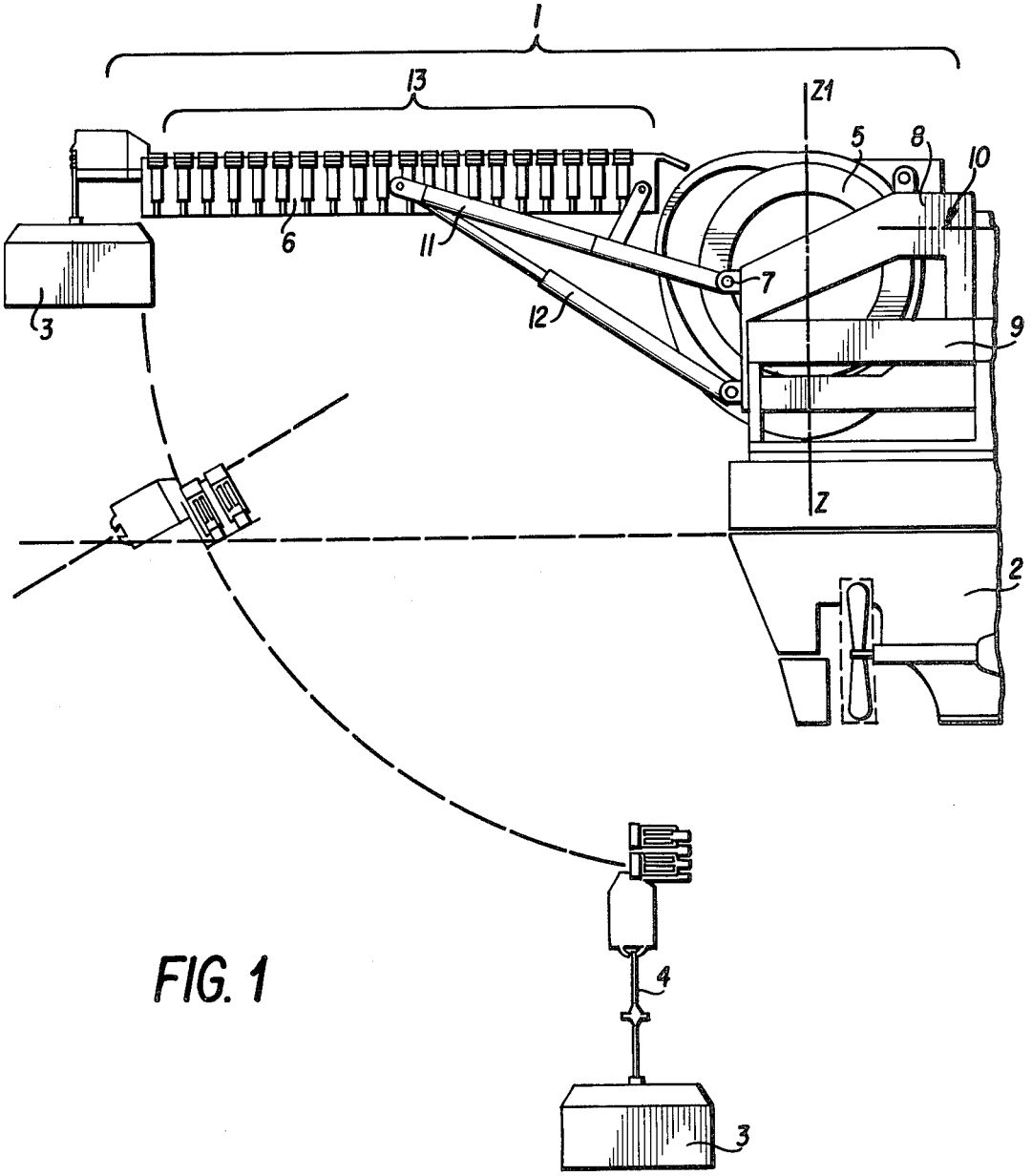
FIG. 1 is an overall view of a device in accordance with the invention, placed on board a surface vessel.

FIG. 1 represents an overall view of a device 1 for handling a submerged load 3 hooked onto the end of a cable 4. In the example shown, the device 1 includes firstly a drum 5 for recovery of the cable 4 and secondly an appliance 13 for straightline haulage upon the cable which is arranged between the load 3 and the recovery drum 5 upon a beam 6 hinged about a transverse axis 7. The beam 6 and the drum 5 are carried by an anti-rolling cradle 8 which is mounted upon a turret 9 installed at the stern of a surface vessel 2. The turret 9 pivots about a vertical axis z–z1 and the cradle 8 is hinged with respect to the turret about a longitudinal axis 10.

FIG. 1 illustrates an example of the emplyment of a recovery drum 5 in accordance with the invention, associated with an appliance 13 for straightline haulage upon the cable 4. This example is not restrictive. The recovery drum 5 and the straightline haulage appliance 13 may be installed upon the bridge of the vessel 2.

In every case of application the recovery drum 5 is associated with an appliance for straightline haulage 13 which exerts upon the cable almost the whole of the force of haulage necessary, so that the drum 5 serves solely for winding up or unwinding the cable under a light tension for recovering it or for paying it out.

Figure 2:
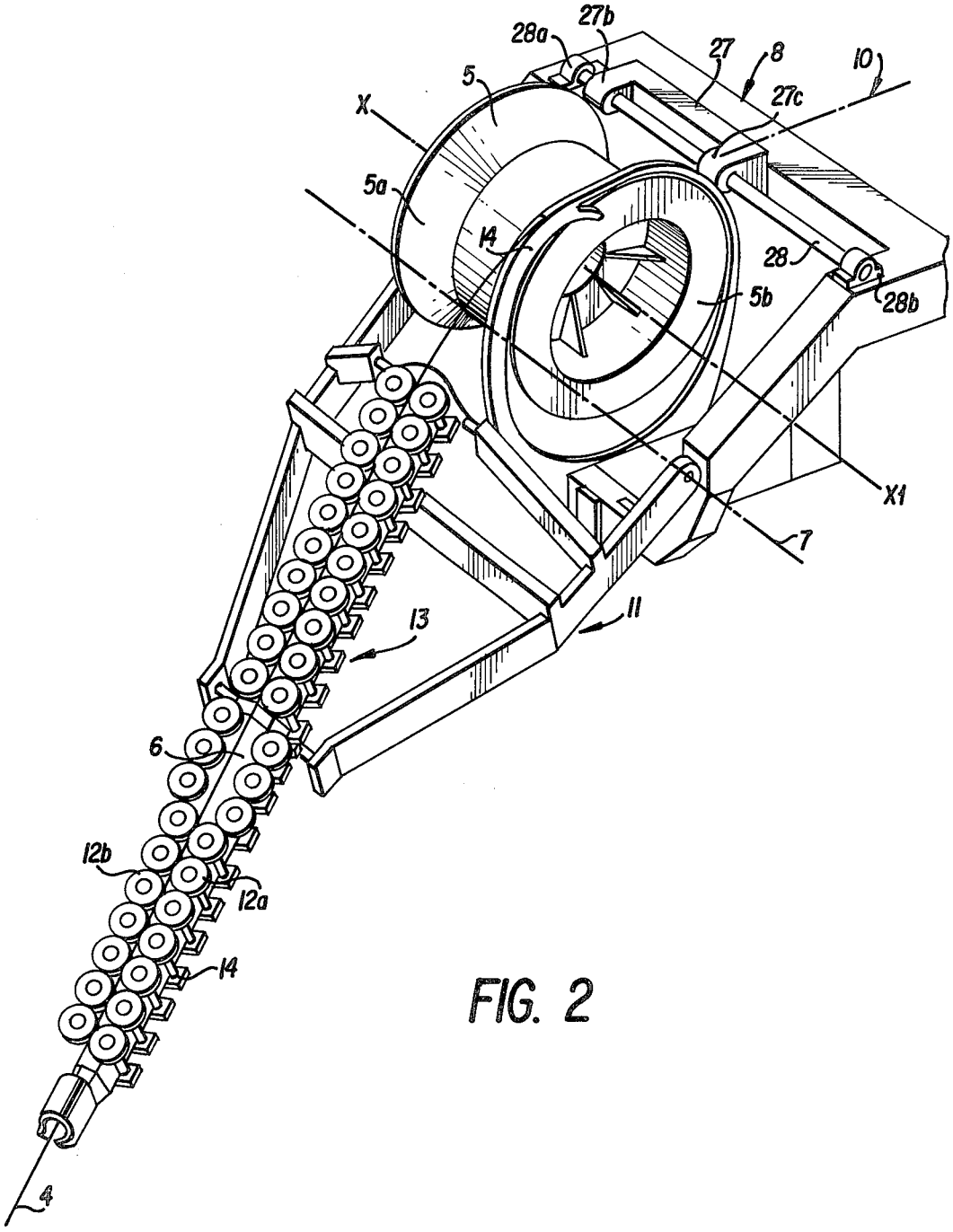
FIG. 2 is a perspective of the cable recovery device.

FIG. 2 is a perspective on a larger scale of the cable recovery device of FIG. 1, located on the anti-rolling cradle 8. In FIG. 2 may be seen the beam 6 carried by a structure 11 hinged about a transverse axis 7, as well as the appliance for straightline haulage 13 composed of pairs of wheels 12*a*, 12*b* having resilient tires driven in rotation by hydraulic motors 14. The cable 4 passes between the pairs of tines which drive it by friction and the top end of the cable is wound onto the drum 5 of the recovery device.

The recovery device includes a drum 5 equipped with two side cheeks 5*a*,5*b*, this drum being driven in rotation about its axis x–x1 by a variable speed motor, for example, a hydraulic motor which is not shown in FIG. 2.

The recovery device includes in addition a passageway 14 in the shape of a loop which surrounds the drum 5. The cable 4 passes inside the passageway 14 and forms inside it a loop of variable length.

Figure 4:
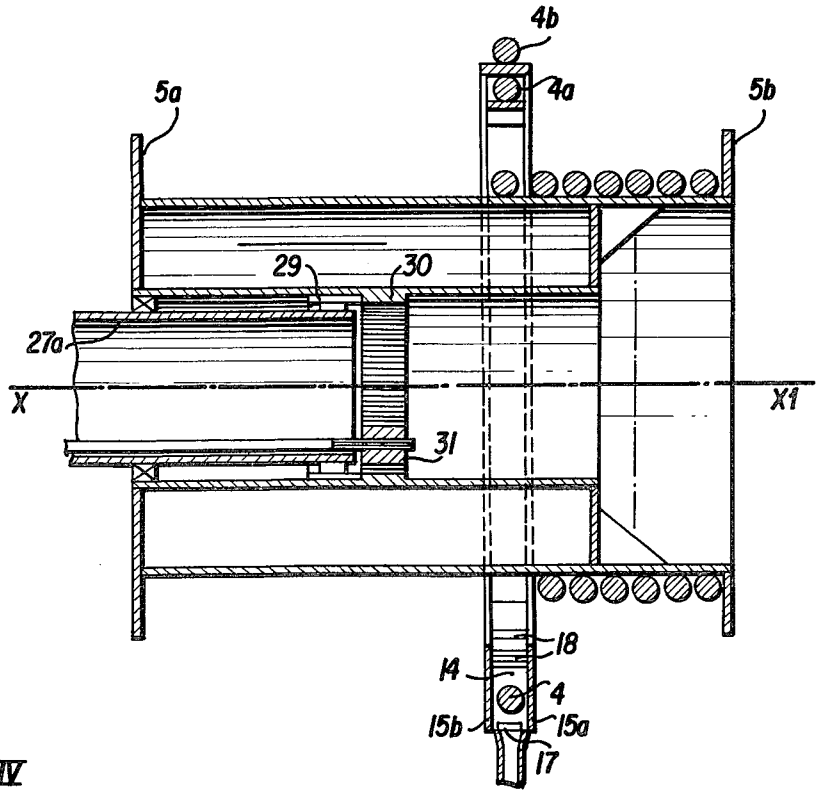
FIG. 4 is an axial section along IV—IV in FIG. 3.
Figure 3:
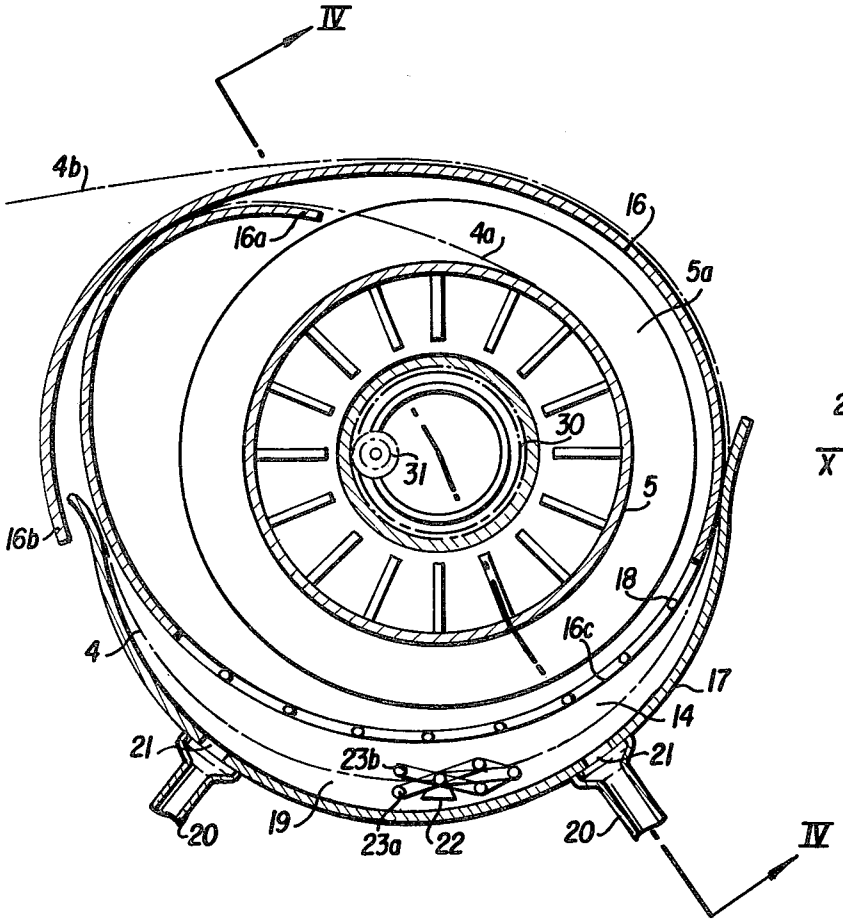
FIG. 3 is a section through FIG. 2 perpendicular to the axis of the drum and passing through the inertia compensator passageway.

FIGS. 3 and 4 represent a cross section and an axial section of the passageway 14 which serves as an inertia compensator.

The passageway 14 includes in the portion located underneath the drum 5 two cheeks 15*a* and 15*b* perpendicular to the axis x–x1 of the drum. The separation between these two cheeks is very slightly greater than the diameter of the cable 4.

The passageway 14 includes in addition two cylindrical surfaces, an inner surface 16 and an outer surface 17 the generatrices of which are parallel with the axis x–x1.

The surfaces 16 and 17 and the two cheeks 15*a* and 15*b* form the four sides of the passageway 14 the cross-section of which through an axial plane is a rectangle.

The inner cylindrical surface 16 completely surrounds the drum 5, forming about it a sort of spiral. The inner end 16*a* of this spiral is a slight distance from the drum 5 and its prolongation has a direction tangential to the said drum, so that the length of cable 4*a* leaving the drum 5 comes and passes over the end 16*a* and then follows the inner surface 16.

The outer end 16*b* of the inner surface 16 envelops the end 16*a* and the length of cable 4*b* which comes out of the passageway 14 leaves it tangentially to the surface 16*b*.

In the example as FIG. 3 the central portion 16*c* of the inner surface 16 is composed of a series of rollers 18 arranged between the two cheeks 15*a* and 15*b*.

The outer cylindrical surface 17 exhibits the shape of a cylindrical sector which surrounds solely the underneath of the drum 5.

The two ends of the cylindrical sector rejoin the inner surface 16 and are applied elastically against the cable 4. The outer surface 17, the two cheeks 15*a* and 15*b* and the cable 4 define a substantially closed crescent-shaped space 19 which extends over the lower half of the periphery of the drum 5.

The passageway 14 includes means of sucking out the air lying in the volume 19 in order to create in the latter a reduced pressure which draws the loop of cable 4 towards the outer surface 17. These means are, for example, vents 20 which are placed round orifices 21 drilled in the outer surface 17. The vents 20 are connected to an air suction apparatus (not shown).

FIG. 3 represents a pick-up 22 of the position of the cable 4 which is located inside the passageway 14.

FIG. 5 represents the pick-up 22 in perspective. The pick-up 22 is composed of two rollers 23*a* and 23*b* between which passes the cable 4. The rollers 23*a* and 23*b* are mounted upon two arms 24*a* and 24*b* hinged together about an axis 25. The two arms 24*a* and 24*b* extend beyond the axis 25 and are connected together by two other arms 24*c* and 24*d* with which they form a hinged parallelogram. This parallelogram includes a diagonal connecting-rod 25*a* which is hinged about the axis 25 and which has a hole 25*b* made oval in which moves a stud 25*c* round which the two arms 24*c* and 24*d* are hinged. The connecting-rod 25*a* is always parallel with the length of cable 4 passing between the rollers. A pick-up of the angular position 25*d*, for example, a potentionmeter pick-up measures the angular position of the connecting-rod 25*a*.

The signal delivered by the pick-up 25*d* makes a motor 26*a* for driving the drum 5 vary automatically in the sense which keeps the angular position of the connecting-rod 25*a* substantially stationary about an initial position which is that which corresponds with the mean length of the loop of cable 4, that is to say, the length of the loop when it is located halfway between the inner surface 16 and the outer surface 17.

Thus when the boat 2 is subjected to rapid motions under the effect of the swell, the length of the loop of cable located in the passageway 14 varies in order to compensate rapidly in one sense or the other the effects of the motion of the boat without creating excess tension in the cable. The pick-up 25*d* detects the variations in length of the loop of cable and it acts upon the motor 26*a* for driving the drum 5 in order to reestablish the mean length of the loop of cable located in the passageway 14 which enables compensation of the inertia of the drum 5 and of its driving motor.

FIG. 6 is an exploded perspective which represents the means of driving the drum 5 in rotation and of axial displacement of the drum with respect to the passageway 14 which is fixed. In FIG. 6 may be seen the anti-rolling cradle 8, the carriage 27, the drum 5 and the passageway 14. The drum 5 includes in its central plane a large-diameter roller bearing 29 equipped with an internally toothed wheel 30. This bearing 29 has its fixed portion integral with the fixed drum 27*a* carried by the carriage 27. The toothed wheel 30 meshes with a pinion 31 which is fixed onto a pivot integral with the drum 27*a*. The pinion 31 has internal splines in which engages a splined shaft 26 driven by a motor 26*a* fixed onto a cheek 26*b* carried by the cradle 8.

The carriage 27 is placed by brackets 27*b* and 27*c* upon a sleeve 29*a* which slides upon a guide rod 28 placed in two supports 28*a* and 28*b* which are fixed at 31*a* and 31*b* onto the cradle 8. A nut 30*b* is fixed to the carriage 27 and a threaded screw 30*d* having a double crossed thread, is screwed into the nut 30*b* and is driven in rotation by a reversible motor 30*a*. The motor 30*a* is fixed to the cradle 8 at 30*c*. The pick-up 25*d* controls the speed of rotation of the motor 26*a* in order to keep the loop of cable located in the space 19 in the mean position.

A second pick-up 32 identical with the pick-up 22 represented in FIG. 5 measures the angle made by the length of cable 4*a* leaving the drum 5, with the central plane of the passageway 14. The pick-up 32 automatically controls the motor 30*a* which runs in two directions, and moves the carriage 27 and hence the drum 5 so as to keep the length of cable 4*a* constantly in the central plane of the passageway 14.

In FIG. 2 is seen the carriage 27 carrying the drum 5 which slides on the guide rod 28 and which is moved with respect to the cradle 8, whilst the passageway 14 occupies a fixed position with respect to the cradle 8 and to the beam 6.

Operation of the compensator passageway 14 is as follows. It supports the cable 4 when the beam 6 pivots about the axis of roll 10, the cable then rubbing along the guide. It compels the cable 4 to make a loop of variable length round the drum 5, which enables a certain length of cable to accumulate or to pay out.

Keeping the space 19 at reduced pressure enables a slight tension to be exerted upon the loop of cable so that it is kept lightly stretched and hence circular. For example, with a cable having a diameter of 37 mm and a diameter of loop of 4500 mm a reduced pressure of 300 mbar enables a pull of 250 daN to be exerted upon the two vertical sides of the loop of cable.

It supports the cable when the diameter of winding onto the drum 5 varies as a function of the length paid out (the cable rubs along the guide).

At no point is the curvature of the cable less than the minimum radius acceptable (nominal radius). A low and regular tension of the cable which is wound onto the recovery drum 5 is ensured, for example, 250 daN. The system of accumulation of a certain length of cable as a result of variations in length of the loop located inside the compensator passageway 14 exerts only the inertia of this loop of cable on the drum. It enables uncoupling to be ensured between the cable which is being wound onto the drum at a speed which cannot be made to vary rapidly and the length of cable which is passing into the appliance for linear haulage 13 which follows the motions of the ship rapidly thanks to the low inertia of the driving rollers 12*a* and 12*b*.

Of course without departing from the scope of the invention the various constituent elements of the cable recovery device which has just been described by way of example may be replaced by equivalent elements which fulfill the same functions.

We claim:

1. A device for recovery of a cable which a surface ship uses to haul a submerged load, comprising:

an appliance for straight line hauling on the cable made of a beam hinged about a first transverse axis relative to said ship and of pairs of wheels applied to said cable for hauling thereof, a drum driven in rotation about a second transverse axis relative to said ship by a variable speed motor and upon which said cable is wound, said drum being carried by an anti-rolling cradle which is mounted upon an elongated turret installed on said ship, said cradle being hinged about a longitudinal axis with respect to said turret, and said turret being mounted rotatively about a vertical axis, wherein said device further includes a loop shaped, cable passageway surrounding said drum which compensates for the inertia of said drum by forming a loop of cable of variable length, and a pick-up of the position of said loop of cable which automatically controls the speed of said motor and drives said drum at a rotational speed which maintains the mean length of said loop of cable.

2. A device as defined in claim 1 wherein said passageway comprises two cheeks perpendicular to the second transverse axis, and an inner and an outer cylindrical surface which generatrices of both are parallel with said second transverse axis and form with said cheeks four sides of said passageway which surrounds the lower position of the periphery of said drum and through which passes said loop of cable of variable length.

3. A device as defined in claim 2, wherein said inner cylindrical surface surrounds completely the periphery of the said drum and said outer surface in the shape of a cylindrical sector surrounds solely the bottom of said drum and the two ends of which rejoin said inner surface so that it defines with the outer surface and the said cheeks a substantially closed space of crescent shape which extends over the lower half of the periphery of the said drum.

4. A device as defined in claim 3 further including means of sucking out the air in said crescent-shaped volume between said loop of cable and said outer surface in order to create a reduced pressure which draws the loop of cable towards the outer surface.

5. A device as defined in claim 3 wherein said pick-up of the position of the said loop of cable is located inside said cresent-shaped space, and wherein said pick-up includes two rollers between which said cable passes and which are mounted upon two arms of a hinged parallelogram, said parallelogram including a connecting-rod which controls the speed of the drum motor and which is located along a diagonal of said parallelogram and which is parallel with the said cable, whereby said pick-up measures the angular position of the said connecting-rod and controls the speed of said drum motor.

6. A device as defined in claim 1 wherein said cradle is locked to a nut mounted on a threaded rod having crossed threads and is rotatably driven by a reversible motor, said motor being controlled automatically by a pick-up of the angular position of the length of cable leaving said drum so that said drum is displaced automatically along said longitudinal axis whilst said passageway is fixed.

7. A device as defined in claim 3, wherein said inner surface displays the shape of a spiral, the inner end of which has a direction tangential to the said drum and the outer end of which envelops the inner end.

8. A device for recovery of a cable which a surface ship uses to haul a submerged load, comprising:

a drum for winding and extending said cable, a variable speed motor for driving said drum at variable speeds, a loop shaped, cable passageway circumscribing said drum for forming a loop of cable variable length and compensating for the inertia of said drum, and means for sensing the length of said cable loop and for automatically controlling the speed of said variable speed motor as a function of said loop length so as to maintain the average length of the cable loop at a constant value over time, whereby said cable may be wound around said drum at a desired uniform tension despite irregularities in tension exerted onto said cable as a result of the movements of said surface ship caused by the water surrounding said ship.

* * * * *